US008356891B2

(12) United States Patent
Takata

(10) Patent No.: US 8,356,891 B2
(45) Date of Patent: Jan. 22, 2013

(54) DAMPER, HEAD UNIT, LIQUID JETTING APPARATUS, AND AIR-DISCHARGE METHOD OF DAMPER

(75) Inventor: Masayuki Takata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 239 days.

(21) Appl. No.: 12/712,595

(22) Filed: Feb. 25, 2010

(65) Prior Publication Data

US 2010/0214384 A1 Aug. 26, 2010

(30) Foreign Application Priority Data

Feb. 25, 2009 (JP) ..... 2009-042112

(51) Int. Cl.
*B41J 2/17* (2006.01)
*B41J 29/38* (2006.01)
*B41J 2/045* (2006.01)

(52) U.S. Cl. ..... 347/94; 347/12; 347/71

(58) Field of Classification Search ..... None
See application file for complete search history.

(56) References Cited

U.S. PATENT DOCUMENTS

| | | | | |
|---|---|---|---|---|
| 7,413,295 | B2 * | 8/2008 | Takata et al. | 347/84 |
| 7,488,060 | B2 * | 2/2009 | Umeda | 347/85 |
| 2006/0176345 | A1 | 8/2006 | Koizumi | |
| 2008/0204506 | A1 | 8/2008 | Nakamura et al. | |
| 2008/0239041 | A1 | 10/2008 | Umeda | |
| 2008/0297545 | A1 | 12/2008 | Umeda | |
| 2008/0297579 | A1 | 12/2008 | Umeda | |
| 2009/0231399 | A1 | 9/2009 | Takemura et al. | |

FOREIGN PATENT DOCUMENTS

| | | | |
|---|---|---|---|
| JP | 2000-158668 | A | 6/2000 |
| JP | 2001-232813 | A | 8/2001 |
| JP | 2004-009450 | A | 1/2004 |
| JP | 2006-163733 | A | 6/2006 |
| JP | 2006-247886 | A | 9/2006 |
| JP | 2007-223328 | A | 9/2007 |
| JP | 2007-245484 | A | 9/2007 |
| JP | 2007-268766 | A | 10/2007 |
| JP | 2008-155617 | A | 7/2008 |
| JP | 2008-238815 | A | 10/2008 |
| JP | 2008-246889 | A | 10/2008 |
| JP | 2009-006695 | A | 1/2009 |
| JP | 2009-023251 | A | 2/2009 |
| WO | 2009/014224 | A1 | 1/2009 |

OTHER PUBLICATIONS

Japan Patent Office, Notice of Reasons for Rejection for Japanese Patent Application No. 2009-042112 (counterpart to above-captioned patent application), mailed Aug. 23, 2011.
Japan Patent Office, Notice of Reasons for Rejection for Japanese Patent Application No. 2009-042112 (counterpart to above-captioned patent application), mailed Jan. 4, 2011.

* cited by examiner

*Primary Examiner* — Stephen Meier
*Assistant Examiner* — Alexander C Witkowski
(74) *Attorney, Agent, or Firm* — Baker Botts L.L.P.

(57) ABSTRACT

A damper includes a reservoir which stores a liquid and damps a pressure fluctuation in the liquid and includes a gas-liquid separation membrane which demarcates an upper portion of the reservoir, and a flexible damper film which demarcates the reservoir at a lower side of the gas-liquid separation membrane. Accordingly, there is provided a damper which is capable of improving an air-discharge efficiency while suppressing an increase in the size, and moreover improving a pressure relaxation efficiency.

15 Claims, 11 Drawing Sheets

DAMPER, HEAD UNIT, LIQUID JETTING APPARATUS, AND AIR-DISCHARGE METHOD OF DAMPER

CROSS REFERENCE TO RELATED APPLICATION

The present application claims priority from Japanese Paten Application No. 2009-042112, filed on Feb. 25, 2009, the disclosure of which is incorporated herein by reference in its entirety.

BACKGROUND OF THE INVENTION

1. Field of the Invention

The present invention relates to a damper, accommodated in a liquid jetting apparatus such as an ink-jet printer, which has a reservoir storing a liquid for relaxing pressure fluctuation of a liquid; a head unit which includes the damper; a liquid jetting apparatus; and a method of discharging air from the reservoir of the damper.

2. Description of the Related Art

An ink jet-printer, as an example of a liquid jetting apparatus, mainly includes a liquid supply unit having: a jetting head in which nozzles are formed; a damper which is connected to the jetting head, which stores a small amount of ink and which absorbs a pressure fluctuation of ink; and a casing which accommodates the jetting head and the damper. This liquid supply unit is arranged to face a transported recording paper, and forms an image on the recording paper by jetting an ink from the nozzles while reciprocating in a direction orthogonal to a transporting direction of the recording paper. Moreover, in such a printer, an ink cartridge of a large capacity which is independent of the liquid supply unit is provided to a body thereof, and the ink cartridge and the damper are connected by a flexible tube. Thus a so-called tube-supply type printer has hitherto been known. Then, a small sizing of the liquid supply unit has been facilitated while increasing an amount of the ink supplied.

In a known printer, four ink reservoirs corresponding to inks of four colors namely, black, cyan, magenta, and yellow are provided in the damper. Each of the ink reservoirs has a thin and flat shape, and the ink reservoirs are stacked in a vertical direction to overlap in a plan view. Moreover, one of an upper portion and a lower portion of each ink reservoir is demarcated by a resin member, and the other one is demarcated by a flexible film. Consequently, a pressure wave generated in the ink is relaxed or absorbed by a deformation of this flexible film, and an ink jetting performance (jetting capability) is stabilized.

It has been known that air grows in a channel which guides the ink from the ink cartridge to the jetting bead when the printer is not used so frequently. When this air enters the jetting head, there is a possibility that a desired jetting performance cannot be achieved. Whereas, when an air storage space having a predetermined capacity for trapping the air is provided, it is possible to prevent an entry of air into the jetting head. However, when this space is made to have a large capacity in order to trap a large amount of air, it becomes difficult to reduce the size of the liquid supply unit. Therefore, in the printer as described above, an ink outflow channel which is elongated in a vertical direction is formed at half way from the ink reservoir to the jetting head, and an opening (upper-opening) is formed in an upper-portion thereof and is covered by a gas-liquid separation membrane. Accordingly, the air is discharged to outside of the ink outflow channel through the gas-liquid separation membrane.

SUMMARY OF THE INVENTION

However, in recent years, a further improvement in an air-discharge efficiency in a damper has been sought. In the printer as described above, when the upper-opening of the ink outflow channel in which the gas-liquid separation membrane is provided for improving the air-discharge efficiency is made larger, the small sizing of the damper becomes difficult. Moreover, the improvement in the pressure relaxation efficiency of the damper has been sought. When an attempt is made to facilitate the improvement in the pressure relaxation efficiency in the above described printer, dimensions in a plan view of the ink reservoir have to be made substantial for making an area of the flexible film substantial, then the small sizing of the damper becomes difficult. This situation is not restricted to the ink-jet printer, and is similar for all liquid jetting apparatuses which have a similar structure.

Therefore, an object of the present invention is to provide a damper which is capable of facilitating an improvement in an air-discharge efficiency while suppressing an increase in the size of the damper, and moreover, an object of the present invention is to provide a damper which is capable of facilitating an improvement in a pressure relaxation efficiency while suppressing the increase in the size of the damper. Furthermore, an object of the present invention is to provide a head unit which includes such damper, a liquid jetting apparatus, and an air-discharge method of the damper.

According to a first aspect of the present teaching, there is provided a damper provided in a channel through which a liquid is supplied to a liquid jetting head, the damper including:

a reservoir which stores the liquid and damps a pressure fluctuation in the liquid, the reservoir including a gas-liquid separation membrane which defines an upper portion of the reservoir, and a damper film which has a flexibility and which defines the reservoir at a lower side of the gas-liquid separation membrane.

In such an arrangement, it is possible to discharge air through the gas-liquid separation membrane at the upper portion while damping a pressure wave by the damper film at the lower portion. Consequently, since it is possible to make the reservoir function as a pressure absorbing chamber, and at the same time, to make function also as a gas-liquid separating chamber, it is possible to facilitate an improvement in an air-discharge efficiency while suppressing an increase in the size of the damper.

According to a second aspect of the present teaching, there is provided a head unit which jets a liquid toward a medium, including a jetting head including a channel unit in which a plurality of nozzles through which the liquid is jetted and a plurality of pressure chambers which are communicated with the nozzles are formed, and a jetting-energy imparting mechanism which imparts a jetting energy to the liquid in the pressure chambers;

a damper according to the first aspect of the present invention, which liquid-communicates with the jetting head; and a carriage case which supports the jetting head and the damper.

According to a third aspect of the present invention, there is provided a liquid jetting apparatus which jets a liquid onto a medium, including a head unit according to the second aspect of the present invention, a transporting mechanism which transports the medium to a position facing the head unit;

a main tank which stores the liquid which is to be supplied to the head unit; and a liquid supply tube which is liquid-communicated with the main tank and the head unit.

In any of the cases, since the damper is provided with both, the damper function and the air-discharge function, it is not necessary to provide an air-discharge mechanism separately, and it is possible to facilitate small sizing of the head unit and the liquid jetting apparatus.

Moreover, according to a fourth aspect of the present invention, there is provided an air-discharge method of damper including:

a recording step of performing a record by jetting a liquid passed through the damper as defined in claim 1, onto a recording medium via nozzles formed in the jetting head;

a purge step of performing a purge by discharging the liquid by jetting the liquid in the nozzles; and an air-discharge step of discharging air in the reservoir via the gas-liquid separation membrane by applying a negative pressure to an upper surface of the gas-liquid separation membrane of the damper, wherein the air-discharge step is performed while the recording step or the purge step is performed. By making such an arrangement, it is not necessary to provide separately a time for carrying out only the air discharge, and it is possible to carry out the air-discharge step together with the recording step or the purge step.

Moreover, according to a fifth aspect of the present invention, there is provided an air discharge method of damper including, a pressurizing step of applying a positive pressure to the reservoir of the damper as defined in claim 1 to discharge an air in the reservoir via the gas-liquid separation membrane which covers the upper portion of the reservoir. By making such an arrangement, it is possible to carry out the air discharge through the gas-liquid separation membrane efficiently by letting the reservoir to be at a positive pressure by using a pump for supplying an ink from the ink cartridge to the damper, and it is not necessary to provide an exclusive pump etc. for letting the reservoir to be at positive pressure.

According to the present invention, it is possible to provide a damper which is capable of improving an air-discharge efficiency and a pressure relaxation efficiency (pressure damping efficiency) while suppressing an increase in the size, and a head unit and a liquid jetting apparatus which include this damper. Moreover, it is possible provide an air-discharge method by such damper.

BRIEF DESCRIPTION OF THE DRAWINGS

FIG. 9A shows a case in which an air-discharge step and a recording step of forming an image on a recording medium are carried out simultaneously, and FIG. 9B shows a case in which the air-discharge step and a purge step of disposing a liquid inside nozzle holes are carried out simultaneously, and carriage case 16 is omitted in the diagram;

FIG. 10A shows a case in which the air-discharge step and the recording step of forming an image on the recording medium are carried out simultaneously, and FIG. 10B shows a case in which the air-discharge step and the purge step of disposing a liquid inside the nozzles holes are carried out simultaneously; FIG. 11A shows as structure having a negative-pressure chamber, and FIG. 11B shows a structure not having the negative-pressure chamber.

DETAILED DESCRIPTION OF THE PREFERRED EMBODIMENTS

A damper and an air-discharge method thereof according to an embodiment of present teaching will be described below with reference to the accompanying diagram. In the following, an example in which the damper is applied to an ink-jet printer (hereinafter, called as a 'printer') having a jetting head is explained. However, the present teaching is not restricted to an application to the printer, and is also applicable to all kinds of liquid jetting apparatuses which jet a liquid other than ink. Moreover, in the following description, each of directions namely 'up', 'down', 'left', 'right', 'front', and 'rear' is defined based on directions shown in FIG. 2. In other words, a direction of jetting ink from the jetting head is defined as the downward direction, and an opposite direction thereof is defined as the upward direction. A scanning direction of the jetting head is defined as the left-right direction, and directions orthogonal to both the vertical direction (up-down direction) and the left-right direction are defined as the front-rear directions.

Outline of Overall Printer

Figure 1:
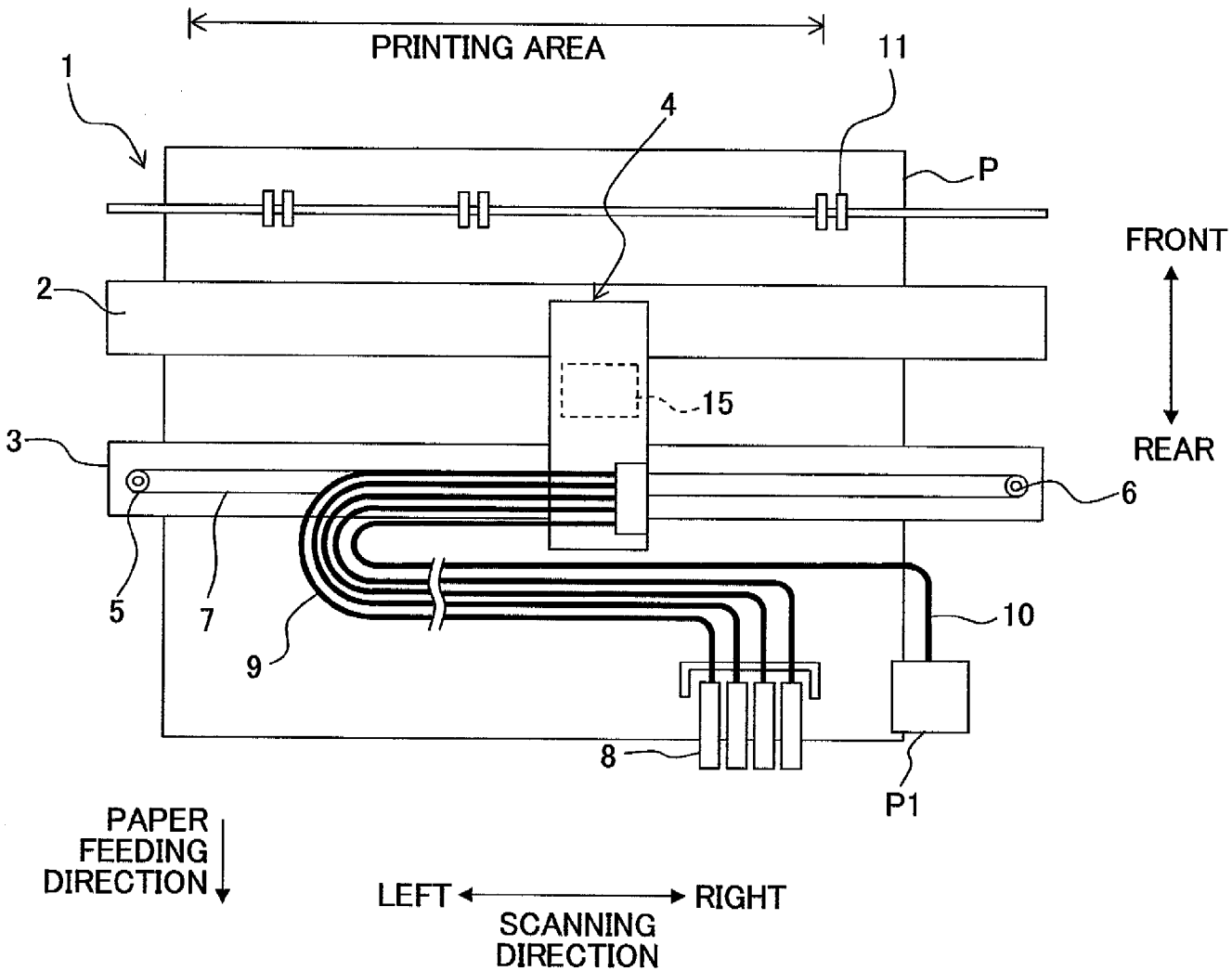
FIG. 1 is a schematic plan view showing main components of a printer 1 as a liquid jetting apparatus which includes a damper according to an embodiment of the present teaching.

As shown in FIG. 1, a printer 1 includes a pair of guide rails 2 and 3 which are extended to be substantially parallel in the left-right direction, a liquid supply unit (a head unit) 4 which is slidably supported on the guide rails 2 and 3, a pair of pulleys 5 and 6 which are arranged near left and right end portions respectively of the guide rail 3, a timing belt 7 which is put around the pulleys 5 and 6 and which is connected to the liquid supply unit 4, and a transporting mechanism such as a transporting roller 11 which transports a recording medium P. A motor (not shown in the diagram) which is rotatable in a CW (clockwise) direction and a CCW (counterclockwise) direction is provided to the pulley 6. The timing belt 7 moves in the CW direction and the CCW direction by the pulley 6 being driven and rotated in the CW direction and the CCW direction. As a result, the liquid supply unit 4 undergoes reciprocated scanning in the left-right direction along the guide rails 2 and 3.

In the printer 1, four ink cartridges (main tanks) 8 of a large capacity are detachably mounted so that these ink cartridges can be replaced. Moreover, four ink supply tubes (liquid supply tubes) 9 which are flexible are connected to the liquid supply unit 4, and inks of four colors (namely, black, cyan, magenta, and yellow) are supplied to the ink cartridges 8 via the ink supply tubes 9. A jetting head 15 (also refer to FIG. 2) is mounted at a lower portion of the liquid supply unit 4. Under the jetting head 15, the recording medium P (such as a recording paper) is transported in a transporting direction orthogonal to the scanning direction. It is possible to form an image on the recording medium by jetting the ink (liquid) from the jetting head 15 onto the recording medium which is transported. The jetting head 15 includes: a channel unit in which a plurality of nozzles for jetting the ink and ink channels such as a plurality of pressure chambers which communicate with the nozzles are formed; and a jetting-energy imparting mechanism which imparts a jetting energy to the ink in the arbitrary pressure chambers. Regarding the jetting-energy imparting mechanism, it is possible to use a piezoelectric actuator in which a piezoelectric element such as PZT is used, and a bubble jet mechanism which imparts thermal energy by heating by a heater etc.

Figure 2:
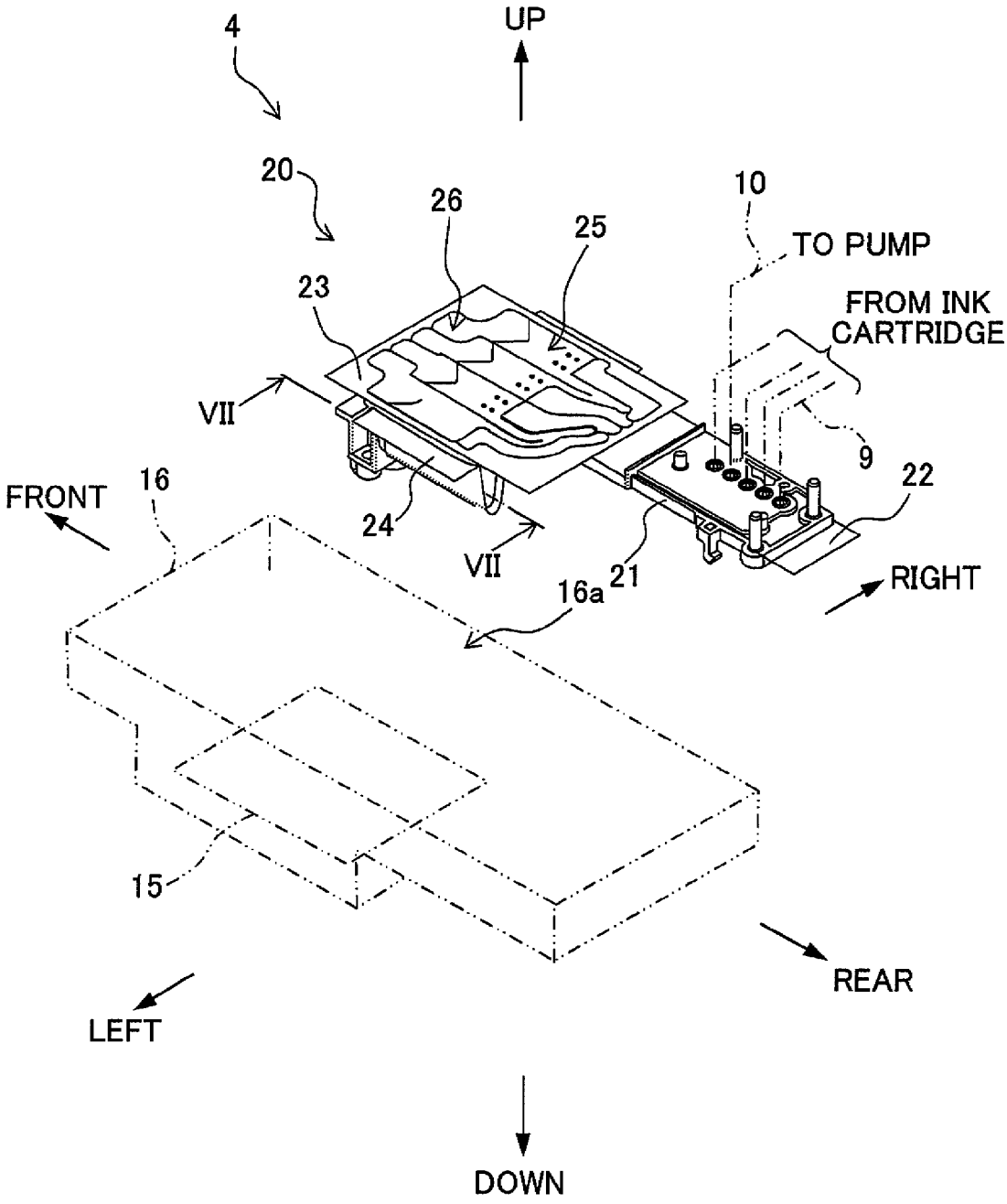
FIG. 2 is an exploded perspective view showing a structure of a liquid supply unit shown in FIG. 1.

As shown in FIG. 2, the liquid supply unit 4 includes a carriage case 16 which supports the jetting head 15, and a damper unit 20 which is accommodated in the carriage case 16 at an upper side of the jetting head 15. The carriage case 16 has a substantially box-shape which is elongated in a front-rear direction, and an opening 16*a* is formed in an upper portion thereof. The damper unit 20 is accommodated through the opening 16*a*.

The damper unit 20 has a substrate 21 of a resin molding which is elongated in the front-rear direction. A plurality of films 22 to 24 in the form of rectangular sheets, and a gas-liquid separation membrane 28 (refer to FIG. 5) are thermally welded to the substrate 21. The ink supply tubes 9 described above, and air-discharge tubes 10 (also refer to FIG. 1) are connected to a rear portion of the substrate 21. Moreover, a damper 25 which reduces or relaxes a pressure fluctuation in ink is provided at a front portion of the damper unit 20. Further, a sub tank 26 which temporarily stores the ink is provided at a further front side thereof. The ink supplied to the damper unit 20 through the ink supply tube 9 is supplied to the jetting head 15 via the damper 25 and the sub tank 26.

Structure of Damper Unit (Ink Channels)

Figure 3:
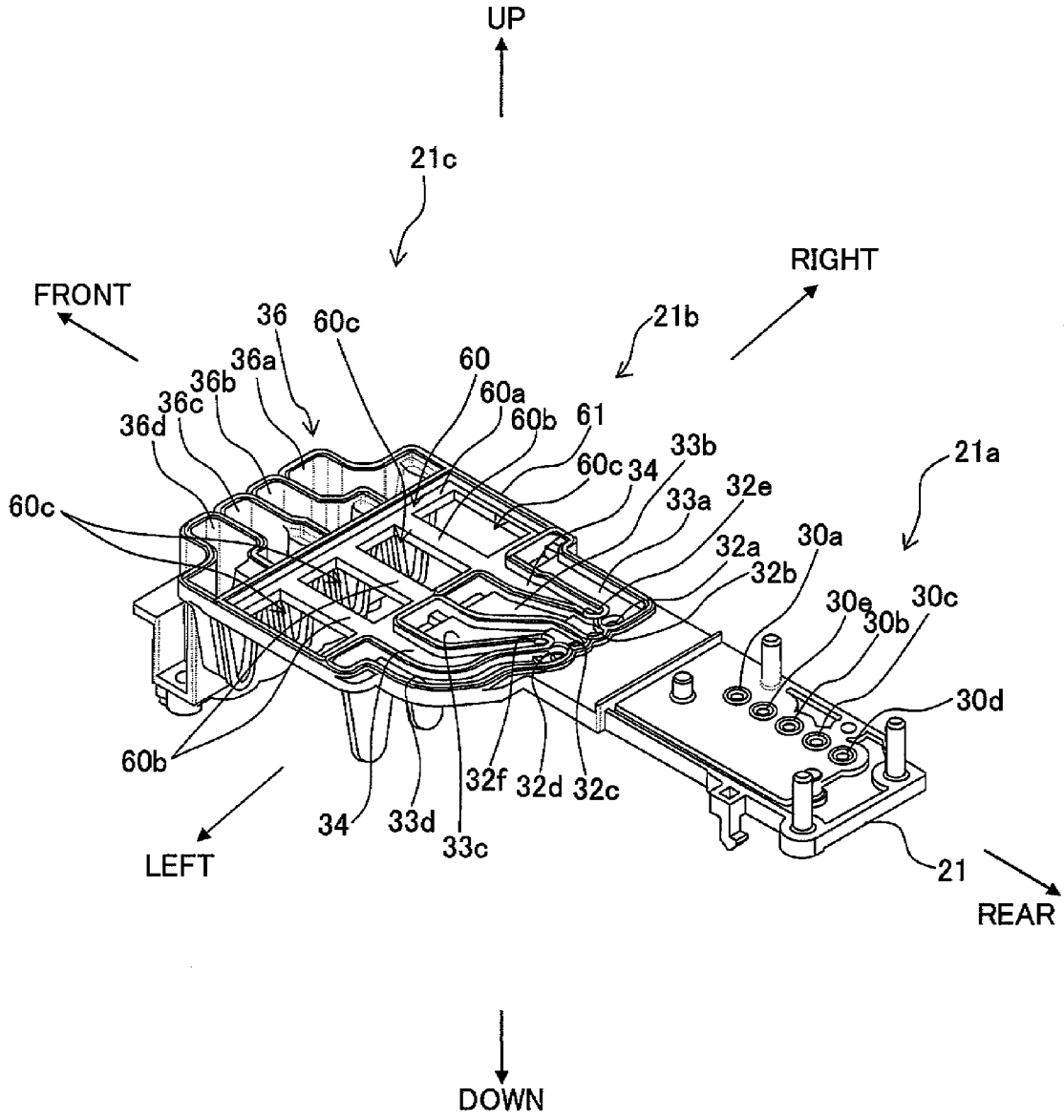
FIG. 3 is a perspective view when a substrate is viewed from the top.

As shown in FIG. 3, a channel forming portion 21*a* which is arranged at a rear portion of the substrate 21, a damper forming portion 21*b* which is arranged in front of the channel forming portion 21*a*, and a tank forming portion 21*c* which is arranged at a further front thereof are provided to the substrate 21 of the damper unit 20. A width (a dimension in the left-right direction) of the channel forming portion 21*a* is smaller than a width of the damper forming portion 21*b* and the tank forming portion 21*c*.

At a right side portion of a rear portion of the channel forming portion 21*a*, four supply-tube connecting holes 30*a* to 30*d* and one air-air-discharge tube connecting hole 30*e*, each of which are formed to be penetrated through the channel forming portion 21*a*, are closely aligned in the front-rear direction. The supply-tube connecting holes 30*a* to 30*d* are arranged in this order from front to rear, and the air-discharge tube connecting hole 30*e* is provided between the supply-tube connecting hole 30*a* and the supply-tube connecting hole 30*b*. Moreover, at a front-end portion of the channel forming portion 21*a*, four supply bypass holes 32*a* to 32*d* and two air-discharge bypass holes 32*e* and 32*f* are formed to be penetrated through the channel forming portion 21*a* in the vertical direction. The supply bypass holes 32*a* to 32*d* are arranged side by side in the left-right direction, and the air-discharge bypass holes 32*e* and 32*f* are arranged at a front side of the supply bypass holes 32*a* and 32*d* which are positioned at the both ends among the supply bypass holes 32*a* to 32*d*.

The ink supply tubes 9 drawn from the ink cartridges 8 are connected to the supply-tube connecting holes 30*a* to 30*d*, and the air-discharge tube 10 drawn from a pump P provided inside the printer 1 is connected to the air-discharge tube connecting hole 30*e* (refer to FIG. 1 and FIG. 2). Since the supply-tube connecting holes 30*a* to 30*d* and the air-discharge tube connecting hole 30*e* are closely arranged in this manner, it is possible to make the substrate 21 compact. Moreover, it is possible to bundle the ink supply tubes 9 and the air-discharge tube 10 connected to these holes. Therefore, it is possible to suppress a variation in a load (repulsion forces) which is exerted to the liquid supply unit 4 from the ink supply tubes 9 and the air-discharge tubes 10.

Five grooves (recesses) which are dented upward are formed in a bottom-surface of the channel forming portion 21*a*. As shown in a perspective bottom view in FIG. 4, a bottom surface of the channel forming portion 21*a* is covered by the film 22. Accordingly, four ink infusing channels 31*a* to 31*d* ranging from the supply-tube connecting holes 30*a* to 30*d* up to the supply bypass holes 32*a* to 32*d*, and one air-discharge infusing channel 31*e* ranging from the air-discharge tube connecting hole 30*e* up to the air-discharge bypass holes 32*e* and 32*f* are defined. The ink infusing channel 31*a* is extended straight toward a front from the supply-tube connecting hole 30*a* which is positioned at the extreme front, and communicates with the supply bypass hole 32*a* which is positioned at a right end. The ink infusing channel 31*b* is extended from the supply-tube connecting hole 30*b* which is positioned at a rear side of the supply-tube connecting hole 30*a*. The ink infusing channel 31*b* is directed frontward upon bending at a halfway after being extended leftward, bypassing the abovementioned supply-tube connecting hole 30*a* and the ink infusing channel 31*a*. Furthermore, the ink infusing channels 31*c* and 31*d* are extended from the supply-tube connecting holes 30*c* and 30*d* positioned further frontward, and communicate with the supply bypass holes 32*c* and 32*d* upon being directed frontward upon bending after being extended leftward similarly as described above.

On the other hand, the air-discharge infusing channel 31*e* is extended from the air-discharge tube connecting hole 30*e*. The air-discharge infusing channel 31*e* is directed frontward upon bending at a halfway after being extended rightward from the air-discharge tube connecting hole 30*e*, bypassing the supply-tube connecting hole 30*a* and the ink infusing channel 31*a* from a different side, and furthermore, is extended leftward upon bending frontward of the supply bypass hole 32*a*, and communicates with the air-discharge bypass hole 32*e* at halfway of the air-discharge infusing channel 31*e* which is directed leftward, and communicates with the air-discharge bypass hole 32*f* at the end. In this manner, the air-discharge infusing channel 31*e* and the ink infusing channels 31*a* to 31*d* ranging from the tube connecting holes 30*a* to 30*e* up to the bypass holes 32*a* to 32*f* are laid out such that these channels do not intersect with each other.

As shown in FIG. 3, grooves (recesses) which communicate individually with the supply bypass holes 32*a* to 32*d* are formed in an upper surface of a rear portion of the damper forming portion 21*b* of the substrate 21. When an upper surface of the damper forming portion 21*b* and an upper surface of the tank forming portion 21*c* are covered by the film 23 (refer to FIG. 4) which is a flexible member, ink connecting channels 33*a* to 33*d* which are extended frontward are defined. Moreover, these ink connecting channels 33*a* to 33*d* communicate with a rear portion of four ink reservoirs 35*a* to 35*d* which are formed in a front portion of the damper forming portion 21*b*, and are arranged side-by-side in the left-right direction (refer to FIG. 4).

Moreover, a groove which communicates with the air-discharge bypass hole 32*f* is formed between the adjacent ink connecting channels 33*a* and 33*b*, and a groove which communicates with the air-discharge bypass hole 32*e* is formed between the ink connecting channels 33*c* and 33*d*. When the ink connecting channels 33*a* to 33*d* are covered by the film 23, air-discharge connecting channels 34 which are extended frontward are defined. These air-discharge connecting channels 34 communicate with a negative-pressure chamber 27 to be described later, which is formed in common at an upper side of the four ink reservoirs 35*a* to 35*d* (refer to FIG. 5).

Figure 4:
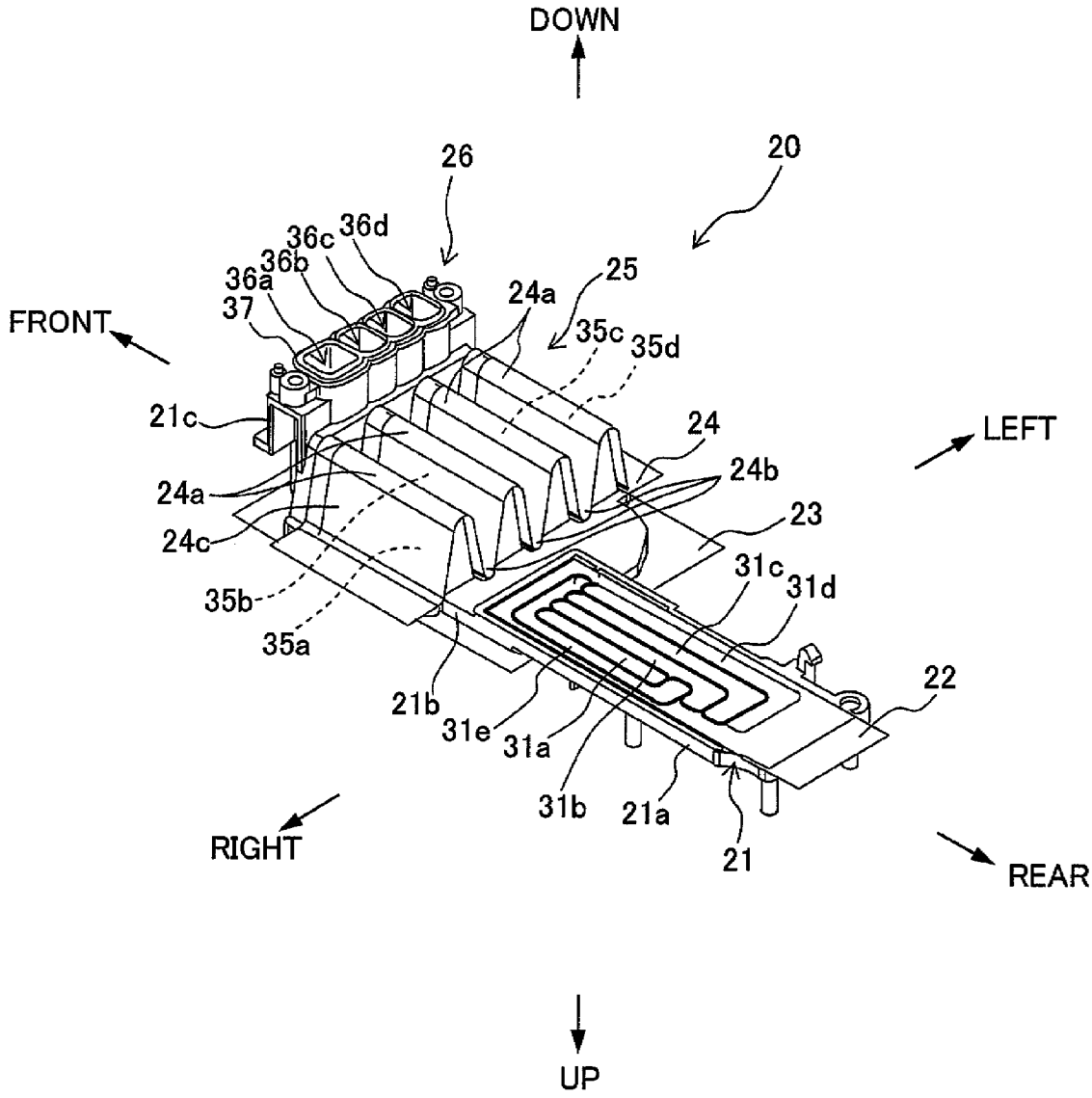
FIG. 4 is a perspective view when a damper in a state of each film and a gas-liquid separation membrane welded to the substrate, is viewed from below.
Figure 7:
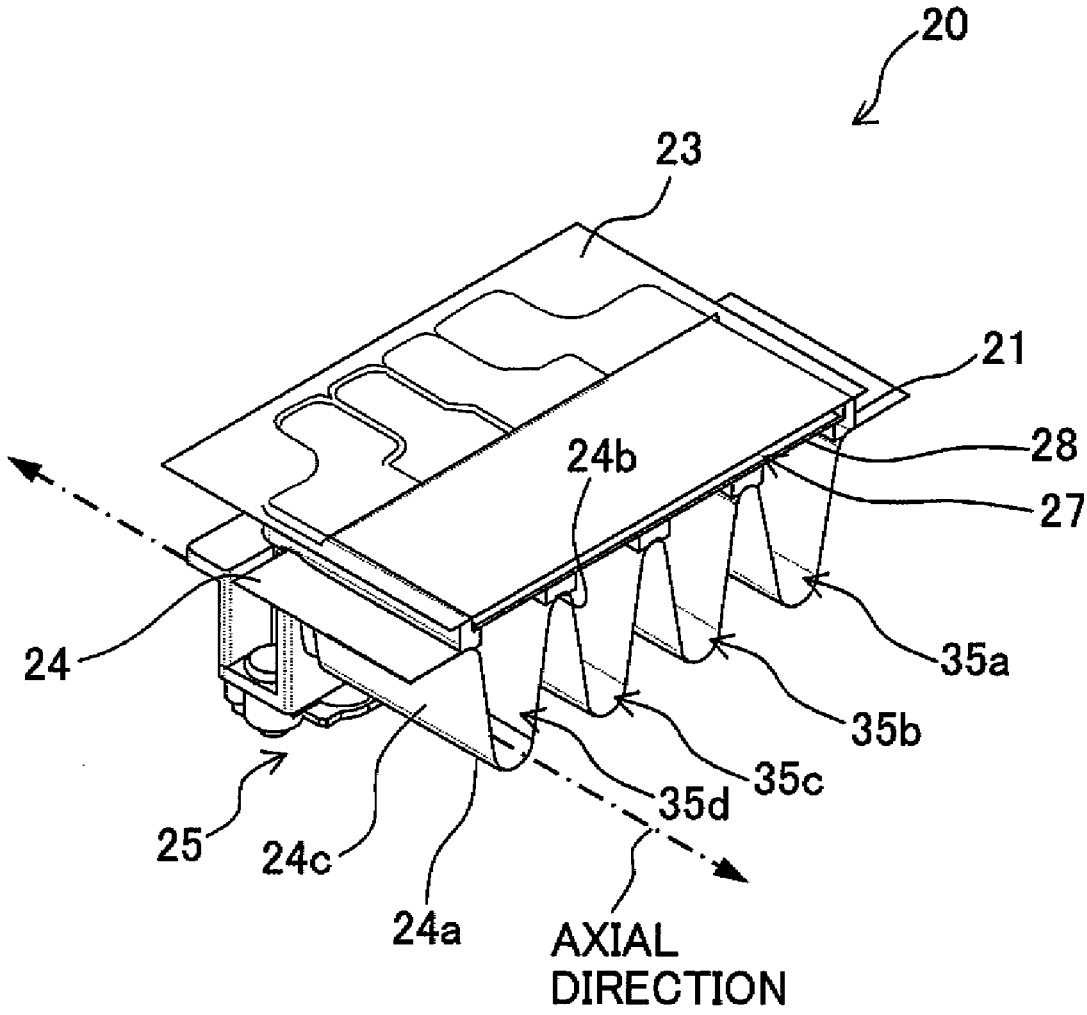
FIG. 7 is a cross-sectional view of a damper when each damper is cut across.

As shown in FIG. 4, the ink reservoirs 35*a* to 35*d* which form the damper 25 are covered by the film 24 from a lower side thereof, and are further covered from an upper side thereof by the gas-liquid separation membrane 28 (refer to FIG. 7). Moreover, the negative-pressure chamber 27 is formed at an upper side of the ink reservoirs 35*a* to 35*d* (refer to FIG. 5). A lower surface of the negative-pressure chamber 27 is demarcated by the gas-liquid separation membrane 28, and an upper surface of the negative-pressure chamber 27 is demarcated by the film 23. A lower surface and left and right surfaces of the ink reservoirs 35*a* to 35*d* are demarcated by the film 24, and an upper surface of the ink reservoirs 35*a* to 35*d* is demarcated by the gas-liquid separation membrane 28. The ink reservoirs 35*a* to 35*d* have a substantially triangular pillar shape extended in the front-rear direction, and are arranged side-by-side in order from right to left of the damper forming portion 21*b* (refer to FIG. 7). Moreover, the negative-pressure chamber 27 has a thin and flat substantially rectangular parallelepiped shape, and is provided to communicate with all upper spaces of the ink reservoirs 35*a* to 35*d*, at an upper side of the ink reservoirs 35*a* to 35*d* (refer to FIG. 7). The ink reservoirs 35*a* to 35*d* and the negative-pressure chamber 27 will be described later in detail.

As shown in FIG. 3, the sub tank 26 which includes four tank chambers 36*a* to 36*d* formed in the tank forming portion 21*c* is provided at a front side of the ink reservoirs 35*a* to 35*d*. The tank chambers 36*a* to 36*d* are aligned in order from a right side to a left side of the tank forming portion 21*c*, and an upper portion of the tank chambers 36*a* to 36*d* is covered by the film 23 together with the ink reservoirs 35*a* to 35*d* (refer to FIG. 2). Since, an upper-space formed in the upper-portion of the ink reservoirs 35*a* to 35*d* and corresponding upper-space formed in the upper-portion of the tank chambers 36*a* to 36*d* are communicated with each other, the ink can pass both ways. Moreover, the upper-space is formed as an air storage portion 38 (refer to FIG. 5) which stores air temporarily. As shown in FIG. 4, a seal member 37 in which four holes communicating with the tank chambers 36*a* to 36*d* is installed on a lower portion of the sub tank 26, and when the damper unit 20 is mounted on the carriage case 16 (refer to FIG. 2), a lower end of the seal members 37 is connected to the jetting head 15.

Figure 5:
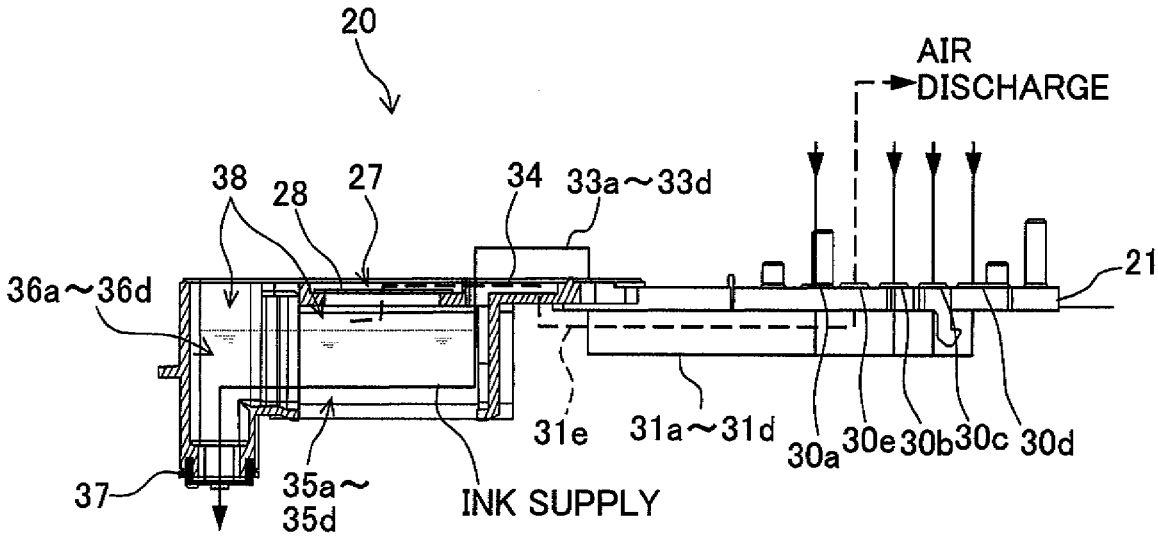
FIG. 5 is a side-surface cross-sectional view of the damper, and shows an ink channel and an air-discharge channel.

As shown by a solid-line arrows in FIG. 5, liquid supply channels ranging from the supply-tube connecting holes 30*a* to 30*d* up to the seal members 37 are formed in the above-mentioned damper unit 20. Ink flowed from the ink supply tubes 9 is supplied to the liquid supply channels from an upper-surface side of the substrate 21, and the ink is guided to the supply bypass holes 32*a* to 32*d* from the supply-tube connecting holes 30*a* to 30*d*, via the ink infusing channels 31*a* to 31*d* at a lower-surface side of the substrate 21. Moreover, the ink passes through the ink connecting channels 33*a* to 33*d* at the upper-surface side of the substrate 21 through the supply bypass holes 32*a* to 32*d*, and is infused into the ink reservoirs 35*a* to 35*d* of the damper 25. Furthermore, the ink inside the ink reservoirs 35*a* to 35*d* are guided to the tank chambers 36*a* to 36*d* communicating at an upper portion thereof. Then, the ink is directed to a lower portion of the tank chambers 36*a* to 36*d*, and is supplied to the jetting head 15 connected via the seal member 37 (refer to FIG. 2).

A pressure fluctuation in the ink is relaxed by the ink reservoirs 35*a* to 35*d* of the damper 25, and air inside the ink is discharged through the negative-pressure chamber 27. In other words, when a pressure of the ink fluctuates by the liquid supply unit 4 being scanned, the pressure fluctuation is relaxed or damped by the damper 25. Particularly, since the lower surface and both side surfaces of the ink reservoirs 35*a* to 35*d* are demarcated by the film 24, it has a high pressure relaxation capability (damping capability). Moreover, air (air bubbles) grown inside the ink are stored in the air reservoir 28 formed at an upper portion of the ink reservoirs 35*a* to 35*d* and the tank chambers 36*a* to 36*d* at halfway in the liquid supply channels. As shown by a broken-line arrow in FIG. 5, the air is sucked from the air reservoir 28 to the negative-pressure chamber 27 through the gas-liquid separation membrane 28, and furthermore, is discharged to an outside from the air-discharge tube connecting hole 30*e* through the air-discharge connecting channel 34 and the air-discharge infusing channel 31*e*.

Ink Reservoir and Negative-Pressure Chamber

Figure 6:
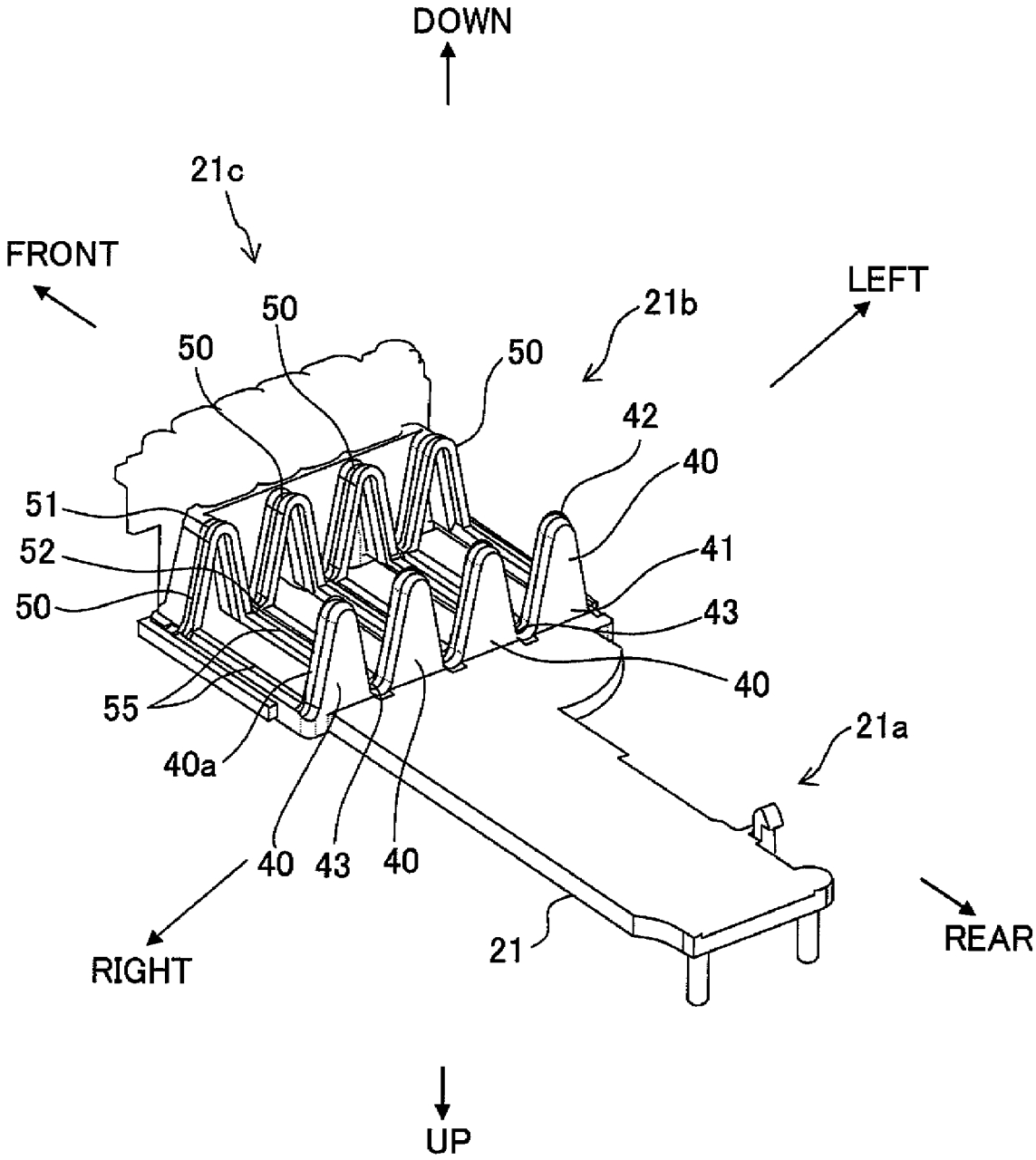
FIG. 6 is a diagram for explaining a structure of the damper, and is a perspective view when the substrate is viewed from below.

Next, a structure of the negative-pressure chamber 27 and the ink reservoirs 35*a* to 35*d* of the damper 25 will be described below in further detail. In FIG. 6, an outline of a structure other than the damper forming portion 21*b* in the substrate 21 is shown without showing the details thereof.

As shown in FIG. 6, four elastic walls 40 having a substantially triangular shape are provided on a lower surface of the damper forming portion 21*b*. The elastic walls 40 are arranged in a row in the left-right direction such that a normal direction thereof coincides with the front-rear direction, and four supporting edge portions 50 are provided to face with the elastic walls 40, at a front side of the elastic walls 40 separated by the same distance. In other words, pairs of the elastic wall 40 and the supporting edge portion 50 are arranged, on the lower surface of the damper forming portion 21*b*, to face with each other in the front-rear direction and four such pairs of the elastic walls 40 and the supporting edge portions 50 are arranged side-by-side in the left-right direction.

All of the elastic walls 40 have a same shape, and each of the elastic walls 40 is isosceles-triangular shaped. A base portion 41 connected to the substrate 21 corresponds to a bottom side, and a front end portion (lower end portion) which is farthest from the substrate 21 corresponds to an apex portion 42, and each of the elastic walls 40 has a bilaterally symmetrical shape. Moreover, the apex portion 42 is rounded to form a circular arc shape protruding downward, and a recess-shaped connecting portion 43 having a circular arc shape dented upward is formed between the base portions 41 of the two adjacent elastic walls 40. Whereas, the supporting edge portion 50 has a substantially same outline shape as a peripheral portion 40*a* of the abovementioned elastic wall 40, and has an apex portion 51 and a recess-shaped connecting portion 52 similar to the apex portion 42 and the recess-shaped connecting portion 43.

On the other hand, a cross-linking rib 55 extending in the front-rear direction is provided between the recess-shaped connecting portion 43 arranged between the adjacent elastic walls 40, and the recess-shaped connecting portion 52 corresponding to the recess-shaped connecting portion 43. A similar cross-linking rib 55 is provided between an outer-side end portion of the base portion 41 of the elastic wall 40 positioned at left and right ends, and an end portion of the corresponding supporting edge portion 50 (refer to FIG. 6). Consequently, in the embodiment, the four elastic walls 40 and the supporting edge portions 50 are linked (connected) by five cross-linking ribs 55. Moreover, the flexible film 24 in the form of a rectangular shape is thermally welded to the elastic walls 40, the supporting edge portions 50, and the cross-linking ribs 55.

As shown in FIG. 4, each of the ink reservoirs 35*a* to 35*d* of the damper 25 has a substantially triangular shape extended in the front-rear direction which is a direction in which the pairs of the elastic walls 40 and the supporting edge portions 50 are arranged in a row. Moreover, as shown in FIG. 7, a cross-sectional shape of each of the ink reservoirs 35*a* to 35*d*, orthogonal to an axial direction thereof (in other words, the direction in which the pairs of the elastic walls 40 and the supporting edge portions 50 are arranged) has an inverted (upside down) triangular shape similar to the elastic wall 40. Each of the ink reservoirs 35*a* to 35*d* is formed as a space of which, a peripheral surface demarcated by the film 24 forms a curved shape.

Concretely, as shown in FIG. 4, a ridge portion 24*a* which is formed by the film 24 and which has a circular-arc shaped cross-section, of which a peripheral surface is defined as a curved shape, is formed on a portion connecting the apex portion 42 of the elastic wall 40 and the apex portion 51 of the supporting edge portion 50, and a valley portion 24*b* which is also formed by the film 24 and which has circular-arc shaped cross-section, of which a peripheral surface is defined as a curved shape is formed in a portion connecting the recess-shaped connecting portions 43 and 52. Since the valley portion 24*b* is welded to be fixed to the cross-linking rib 55, color-mixing of inks between the adjacent ink reservoirs 35*a* to 35*d* is prevented. Whereas, since the ridge portion 24*a* is not welded to the substrate 21 etc., it exerts flexibility.

Consequently, when a negative pressure is developed by fluctuating of pressure inside the ink reservoirs 35*a* to 35*d*, the ridge portion 24*a* and a side-wall surface 24*c* located between the ridge portion 24*a* and the valley portion 24*b* (refer to FIG. 4) are deformed to be bent inward, and the shape of the ink reservoirs 35*a* to 35*d* changes three-dimensionally to vary a volume of the ink reservoirs 35*a* to 35*d*. Moreover, since the film 24 is formed of a flexible material having a favorable response to the pressure fluctuation, and since a movable area of the film 24 is secured widely over the ridge portion 24*a* and the side-wall surface 24*c*, it is possible to exert a superior damper performance. Furthermore, in accordance with the deformation of the film 24, when the apex portion 42 of the elastic wall 40 bends inward with respect to the base portion 41 and the negative pressure is released, it is possible to restore the film 24 promptly to an original state due to an elastic force of the elastic wall 40.

Next, the negative-pressure chamber 27 will be described below. As shown in FIG. 3, a supporting frame 60 to which the gas-liquid separation membrane 28 is to be welded is formed at an upper portion of the damper forming portion 21*b* of the substrate 21, and a connecting edge portion 61 in the form of a rectangular frame which is to be welded to the film 23 is formed to be protruded from an outer peripheral edge portion of the supporting frame 60.

The supporting frame 60 includes an outer frame 60*a* having a rectangular shape which surrounds all the ink reservoirs 35*a* to 35*d*, and three partition frames 60*b* which are provided to be cross-linked in the frontward and rearward direction at an inner side of the outer frame 60*a*, to separate the ink reservoirs 35*a* to 35*d*. Accordingly, four air passing ports 60*c* which are opened to communicate with the ink reservoirs 35*a* to 35*d* at an upper side thereof are formed. The air passing ports 60*c* are formed such that the air passing ports 60*c* have substantially rectangular shaped, in which the length thereof in the front-rear direction is longer than that in the left-right direction, and that the air passing ports 60*c* overlaps perfectly with the ink reservoirs 35*a* to 35*d* in a plan view. Furthermore, an area of opening of the air passing port 60*c* is secured to become as large as possible. The supporting frame 60 is formed to be flat such that, an upper surface of the outer frame 60*a* and an upper surface of the partition frame 60*b* are positioned in the same plane, and one gas-liquid separation membrane 28 is thermally welded onto the upper surface of the outer frame 60*a* and the partition frame 60*b* to cover all the air passing ports 60*c*.

Due to the gas-liquid separation membrane 28 which is thermally welded as described above, an upper surface of the ink reservoirs 35*a* to 35*d* is demarcated, and also a lower surface of the negative-pressure chamber 28 is demarcated. Moreover, air can flow from the ink reservoirs 35*a* to 35*d* to the negative-pressure chamber 27 through the gas-liquid separation membrane 28 which closes the air passing port 60*c*, and at the same time, ink cannot flow. The cross-linking rib 55 which has already been described, is provided to a lower portion of both left and right side portions of the outer frame 60*a*, and a lower portion of each partition frame 60*b*.

Whereas, the connecting edge portion 61 has a rectangular frame shape which is protruded (extended) to a predetermined height from an outer peripheral edge portion of the outer frame 60*a*, and the film thermally welded to an upper end thereof. Moreover, the upper surface of the negative-pressure chamber 27 is demarcated by the film 23 which is welded.

Figure 8:
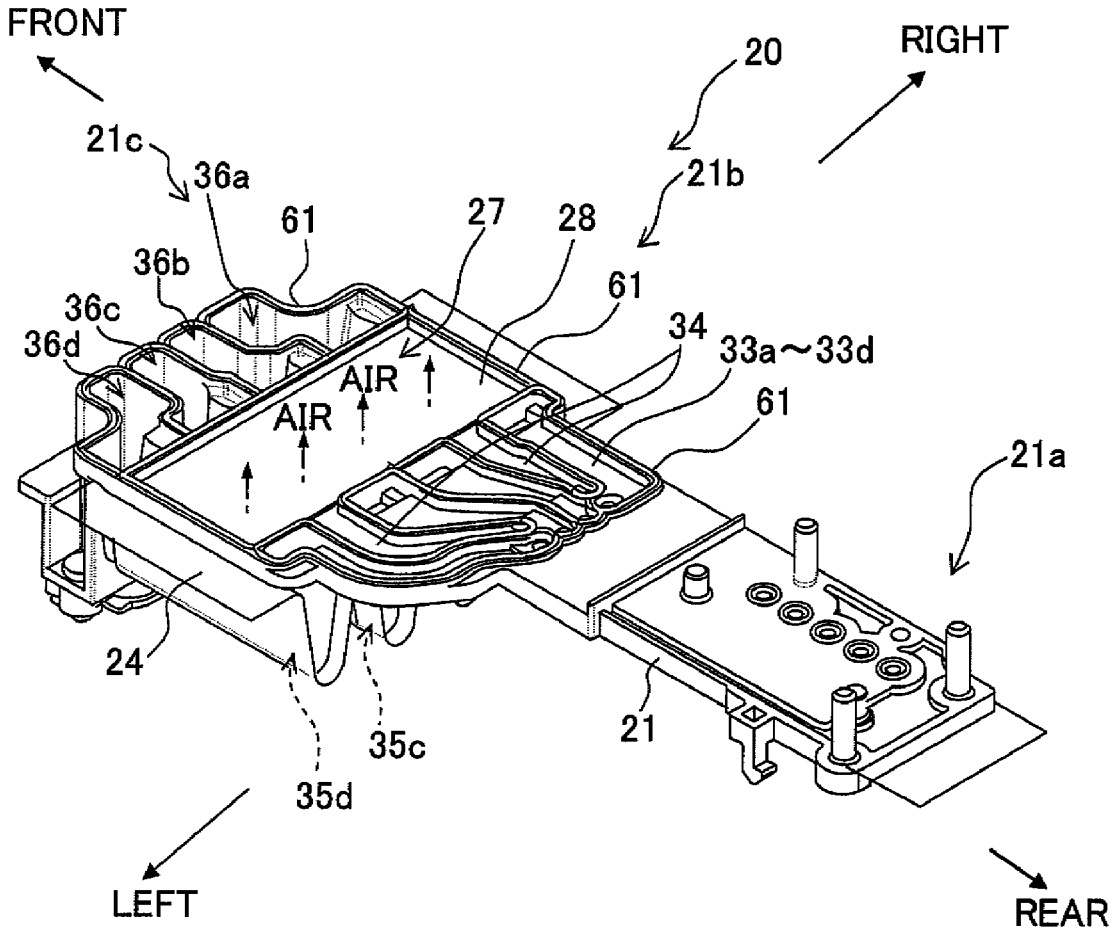
FIG. 8 is a perspective view showing a structure when the damper in a state of a film welded to a damper forming portion from a lower side, and the gas-liquid separation membrane is welded to a supporting frame from an upper side, is viewed from above.

As shown in FIG. 8, the connecting edge portion 61 is also formed on upper surface of the substrate 21 at a peripheral portion of the air-discharge connecting channel 34 and the ink connecting channels 33*a* to 33*d*, and at an upper surface of a wall portion which demarcates the tank chambers 36*a* to 36*d*, in addition to the abovementioned damper forming portion 21*b*. Here, the connecting edge portion 61 is formed to be positioned in a substantially same plane throughout the entire length thereof. Consequently, at the time of welding the film 23 to the upper surface of the substrate 21, not only the negative-pressure chamber 27 but also the ink connecting channels 33*a* to 33*d*, the air-discharge connecting channel 34, and the tank chambers 36*a* to 36*d* are formed simultaneously. Moreover, at the same time, a connecting edge portion for connecting to the film 22 (not shown in the diagram) is formed on a lower surface of the substrate 21 at a peripheral portion of the air-discharge infusing channel 31*e* and the ink infusing channels 31*a* to 31*d*. The connecting edge portion 61 is also formed to be positioned in a substantially same plane throughout the entire length thereof. Therefore, at the time of welding the film 22 to the lower surface of the substrate 21, the ink infusing channels 31*a* to 31*d* and the air-discharge infusing channel 31*e* are formed simultaneously.

As shown in FIGS. 5 and 7, the negative-pressure chamber 27 formed in such manner is positioned above the air storage portion 38 located at the upper portion of the ink reservoirs 35*a* to 35*d*. The gas-liquid separation membrane 28 is located between the negative-pressure chamber 27 and the air storage portion 38. Moreover, the negative-pressure chamber 27 is connected to a pump P1 (a decompression pump: refer to FIG. 1) which is provided to a body of the printer 1, through the air-discharge connecting channel 34, the air-discharge infusing channel 31*e*, the air-discharge tube connecting hole 30*e*, and the air-discharge tube 10. Consequently, when air is sucked by the pump P1 through the air-discharge tube 10, only air inside the air storage portion 38 is sucked to the negative-pressure chamber 27 via the gas-liquid separation membrane 28, and furthermore, the sucked air is further sucked to the pump P1 via the air-discharge connecting channel 34, the air-discharge infusing channel 31*e*, the air-discharge tube connecting hole 30*e*, and the air-discharge tube 10, and the air is discharged toward atmosphere.

As described above, in the damper 25 according to the embodiment, the lower portion of each of the ink reservoirs 35*a* to 35*d* is demarcated by the film 24, and the upper portion of each of the ink reservoirs 35*a* to 35*d* is demarcated by the gas-liquid separation membrane 28. Therefore, it is possible not only to exert a function of absorbing the pressure as a damper, but also to discharge air in the ink through the gas-liquid separation membrane 28. Accordingly, it contributes to small sizing of the damper 25. Moreover, since the ink reservoirs 35*a* to 35*d* are arranged side-by-side not in the vertical direction but in the left-right direction, it is possible to secure a depth dimension of each of the ink reservoirs 35*a* to 35*d* comparatively substantially, and to secure a dimension in the front-rear direction which corresponds to a flow direction of ink. In this manner, since each of the ink reservoirs 35*a* to 35*d* is formed to be elongated in the front-rear direction corresponding to the flow direction of ink, it is possible to secure a time for which the ink stays inside the ink reservoirs 35*a* to 35*d* to be long. In other words, since it is possible to secure a time for which air mixed in the ink rises up due to a buoyancy to be long, it is easy to trap the air in the air storage portion 38, and an improvement in a gas-liquid separating capacity is facilitated.

Furthermore, in the embodiment, since one sheet of the gas-liquid separation membrane 28 is welded to close all of the air passing ports 60*c*, it is possible to reduce the number of manufacturing steps (processes) as compared to a case in which each of the air passing ports 60*c* is closed by an individual gas-liquid separation membrane. Moreover, since it is possible to reduce a width dimension of the partition frame 60*b* on which the gas-liquid separation membrane 28 is welded, small sizing of the damper 25 is possible.

Although a structure of the air passing port 60*c* which is formed to be as large as possible is disclosed in the embodiment, the air passing port 60*c* may have a smaller shape of the opening. In other words, as long as it is possible to exert sufficient gas-liquid separating function practically, the air passing port 60*c* may have an arbitrary shape and size. For instance, when it is possible to exert the sufficient gas-liquid separating function practically, the air passing port 60*c* may be an anterior half or a posterior half of the air passing port 60C as shown in FIG. 3. In this case, it is possible to make small the dimensions of the gas-liquid separation membrane 28. Moreover, for preventing an entry of air from the negative-pressure chamber 27 to the air storage portion 28, a predetermined liquid may be applied in advance on the upper surface (surface toward the negative-pressure chamber 27) of the gas-liquid separation membrane 28. Here, as the liquid to be coated, it is preferable to use a liquid having a low volatility, low rise in viscosity due to drying, and which does not have an adverse effect on the ink. Preferably, it is possible to use a liquid such as glycerin water.

Air-Discharge Method by Negative Pressure

Next, an air-discharge method in the damper 25 in the printer 1 according to the embodiment will be described below.

Figure 9A:
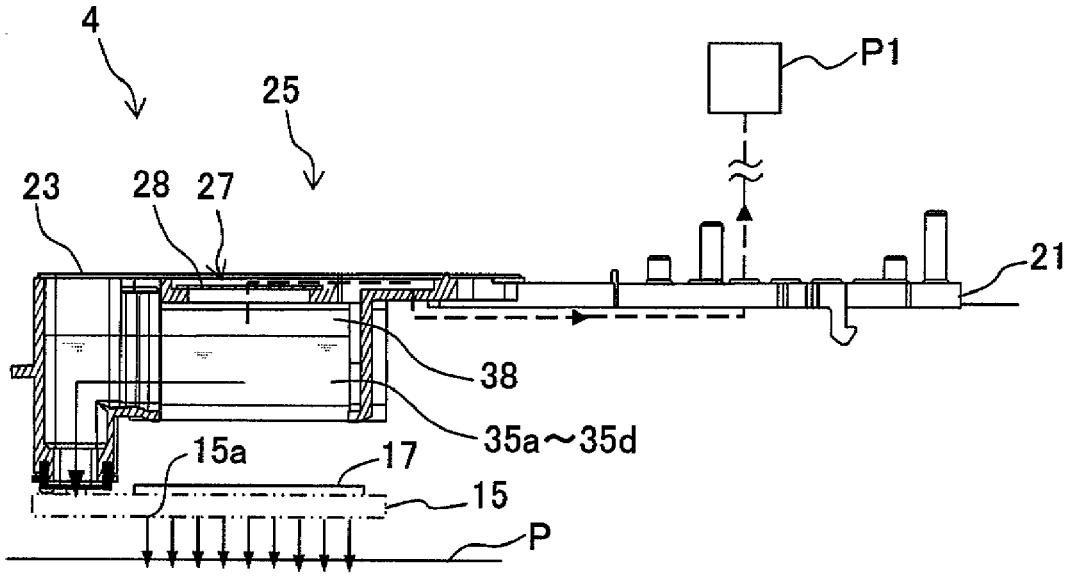
FIG. 9A and FIG. 9B are side-surface cross-sectional views of the liquid supply unit for explaining an air-discharge method, where.

Regarding a method as shown in FIG. 9A, in a recording step of forming an image on a recording medium, an actuator 17 having a piezoelectric element which is joined to an upper surface of the recording head 15 is driven. When the actuator 17 is driven, a jetting pressure is applied to the ink in the channel formed in the jetting head 15, and the ink is jetted from a nozzle 15*a* toward the recording medium (such as a recording paper). Moreover, due to a negative pressure developed in the ink inside the jetting head 15 after jetting, the ink inside the ink reservoirs 35*a* to 35*d* is supplied to the jetting head 15.

On the other hand, an air-discharge step is carried out simultaneously with such recording step. Concretely, as described above with reference to FIG. 5, a space formed inside the negative-pressure chamber 27 is let to be under negative pressure by the pump P1, and air inside the air storage portion 38 at the upper portion of the ink reservoirs 35*a* to 35*d* is discharged to the negative-pressure chamber 27 through the gas-liquid separation membrane 28. Furthermore, this air is sucked into the pump P1 through the air-discharge connecting channel 34, the air-discharge infusing channel 33*e*, and the air-discharge tube 10, and discharged to the atmosphere. In this manner, when the air-discharge step is carried out while the recording step is being carried out, it is not necessary to provide separately a time for carrying out only the air discharge.

Figure 9B:
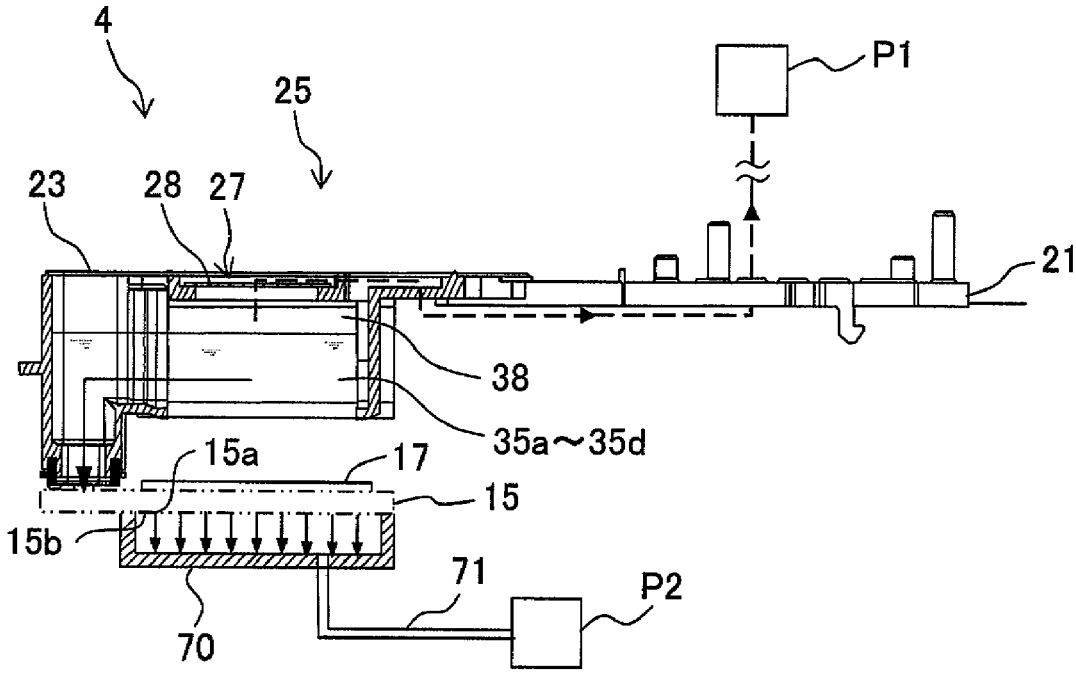

Regarding a method as shown in FIG. 9B, in a purge step, the liquid supply unit 4 stops at a predetermined position in the printer 1. A nozzle surface 15*b* of the jetting head 15 is covered by a cap 70 such that all of the nozzles 15 are covered. In this state, a pump P2 connected to an internal space of the cap 70 via a tube 71 is driven to suck air inside the cap 70. Accordingly, the ink inside the nozzles 15*a* of the jetting head 15 is discharged into the cap 70, and the purge step is completed. In this purge step, the ink inside the nozzles 15*a* is sucked and discharged by the pump P. Instead of this, or in addition to this, the ink may be discharged by jetting from the nozzle hole 15*a* by driving the actuator 17.

On the other hand, the air-discharge step is carried out simultaneously with the purge step. Since the content of the air-discharge step is same as explained with reference to FIG. 9A, the content is omitted. Since the air-discharge step is carried out while the purge step is being carried out in this manner, it is not necessary to provide separately a time for carrying out only the air discharge. In the description with reference to FIGS. 9A and 9B, a procedure for carrying out the air-discharge step simultaneously with the recording step or the purge step has been described. However, it is needless to mention that it is not necessarily required to carry out these steps simultaneously, and that an arrangement may be made such that the air-discharge step is carried out separately from the recording step and the purge step.

Air-Discharge Method by Positive Pressure

In the abovementioned description, the structure and the method for sucking and discharging the air inside the air storage portion 38 have been described. In this case, the negative pressure is applied in the negative-pressure chamber 27 by the pump P1 which is provided exclusively for the air discharge. Whereas, it is also possible to discharge the air inside the air storage portion 38 to the atmosphere through the gas-liquid separation membrane 28 when a positive pressure is applied in the air storage portion 38. Such air-discharge method by positive pressure will be described below.

Figure 10A:
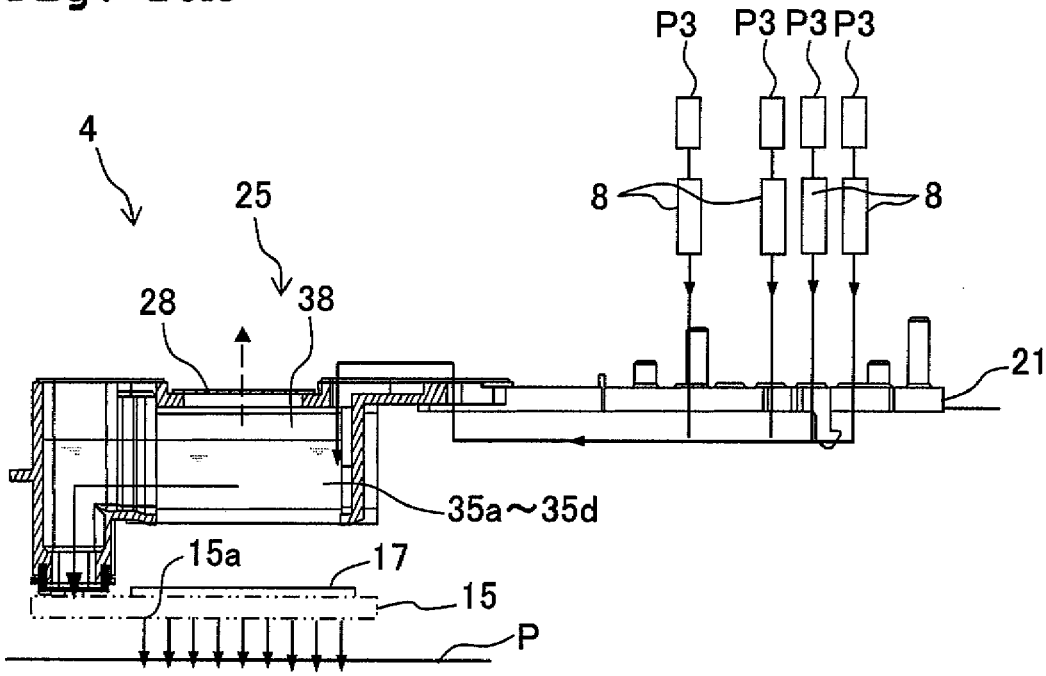
FIG. 10A and FIG. 10B are side-surface cross-sectional views of the liquid supply unit for explaining the air-discharge method by a positive pressure, where.

As shown in FIG. 10A, a pump P3 which supplies ink inside the ink cartridges 8 to the ink reservoirs 35*a* to 35*d* is connected to each of the ink cartridges 8 which communicate with the supply-tube connecting holes 30*a* to 30*d* via the ink supply tubes 9. Moreover, the front portion of the damper forming portion 21*b* in the substrate 21 of the damper unit 20 is not covered by the film 23, and the gas-liquid separation membrane 28 is exposed to the outside. In other words, the gas-liquid separation membrane 28 is exposed to an atmospheric space of the outside of the damper 25.

The recording step in the liquid supply unit 4 is similar to the operation which has already been described, and when the actuator 17 is driven, the ink in the ink reservoirs 35*a* to 35*d* is supplied to the jetting head 15, and is jetted from the nozzles 15*a* toward the recording medium to form an image on the recording medium. Whereas, in a mode shown in FIG. 10A, the pump P3 (a booster pump) is driven during the recording step, and when the positive pressure is applied to the ink in the ink cartridges 8, the ink is supplied from the ink cartridges 8 to the ink reservoirs 35*a* to 35*d*. Moreover, at the same time, the positive pressure applied to the ink in the ink reservoirs 35*a* to 35*d* is used for performing the air-discharge step of discharging the air inside the air storage portion 38 to the outside through the gas-liquid separation membrane 28.

Figure 10B:
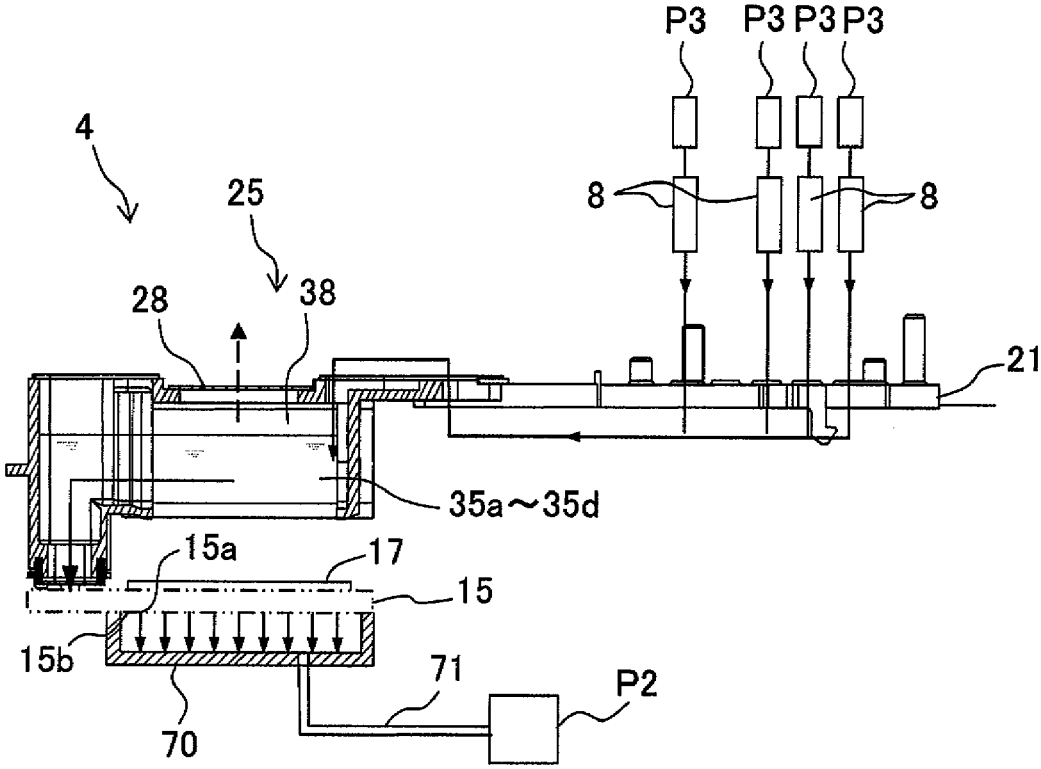

Regarding an operation as shown in FIG. 10B, in the purge step, similarly as the operation which has already been described, the liquid supply unit 4 stops at a predetermined position in the printer 1, and the nozzle surface 15*b* of the jetting head 15 is covered from a lower side by the cap 70. In this state, the pump P2 connected to the internal space of the cap 70 via the tube 71 is driven and the air inside the cap 70 is sucked. Accordingly, the ink in the nozzles 15*a* of the nozzle head 15 is disposed into the cap 70, and the purge step is completed. Whereas, in an operation as shown in FIG. 10B, the pump P3 is driven during the purge step, and similarly as mentioned above, the ink is supplied from the ink cartridges 8 to the ink reservoirs 35*a* to 35*d*. Then, the air-discharge step of discharging air in the air storage portion 38 to the atmosphere through the gas-liquid separation membrane 28 is carried out by using the positive pressure applied to the ink.

Since the air-discharge step is carried out while the recording step or the purge step is being carried out, it is not necessary to provide separately the time for carrying out only the air discharge. Moreover, since the air is discharged by using the positive pressure inside the ink reservoirs 35*a* to 35*d*, the air-discharge tube 10 for sucking by the pump P1 is unnecessary, and it is possible to discharge the air passed through the gas-liquid separation membrane 28 instantly. In the description with reference to FIGS. 10A and 10B, although a procedure for carrying out the air-discharge step simultaneously with the recording step or the purge step has been described, it is not necessarily required to carry out these steps simultaneously, and it is needless to mention that an arrangement may be made such that the air-discharge step is carried out separately from the recording step and the purge step.

Structure of Another Damper

In the abovementioned embodiment, the structure in which the lower surface and the two of the side surfaces of the ink reservoirs 35*a* to 35*d* are defined by the film 24 and the upper surface of the ink reservoirs 35*a* to 35*d* is defined by the gas-liquid separation membrane 28 has been disclosed. However, the damper according to the present teaching is not applicable only to such structure, and an example of a structure of another damper will be described below.

Figure 11A:
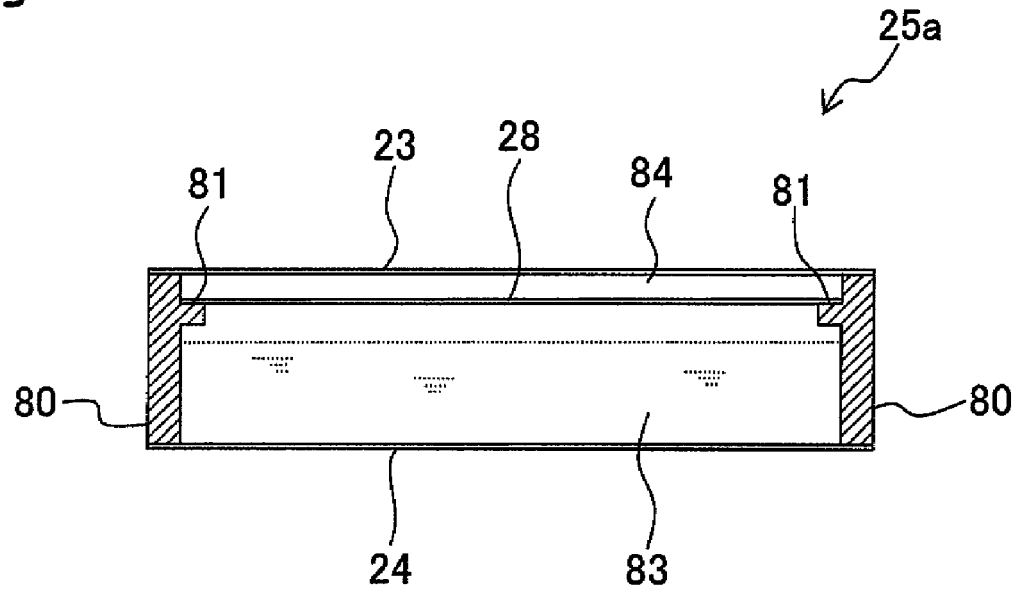
FIG. 11A and FIG. 11B are schematic side-surface cross-sectional views showing a structure of another damper, where.

A damper 25*a* as shown in FIG. 11A includes a peripheral wall portion 80 in the form of a rectangular frame in a plan view, and the film 23 is welded to an upper-end surface thereof, and the film 24 is welded to a lower-end surface thereof. Moreover, a supporting portion 81 is provided over the entire periphery of the peripheral wall portion 80, to be protruded inward from an upper-portion inner surface of the peripheral wall portion 80, and an air passing port 82 is formed at an inner side of the supporting portion 81. The gas-liquid separation membrane 28 is provided such that the air passing port 82 is closed, and an outer peripheral edge portion of the gas-liquid separation membrane 28 is welded to an upper surface of the supporting portion 81.

As a result, the damper 25*a* is divided into an ink reservoir 83 which is positioned at a lower side of the damper 25*a* and a negative-pressure chamber 84 which is positioned at an upper side of the damper 25*a*. The gas-liquid separation membrane 28 is arranged between the ink reservoir 83 and the negative-pressure chamber 84. Moreover, only a lower surface of the ink reservoir 83 is demarcated by the film 24, and an upper surface of the ink reservoir 83 is demarcated by the gas-liquid separation membrane 28. A lower surface of the negative-pressure chamber 84 is demarcated by the gas-liquid separation membrane 28, and an upper surface of the negative-pressure chamber 84 is demarcated by the film 23.

Even in such damper 25*a*, when a negative pressure is applied in the negative-pressure chamber 84 by the pump P1 etc. similarly as it has already been described, it is possible to guide air trapped in an upper portion of the ink reservoir 83 to the negative-pressure chamber 84 through the gas-liquid separation membrane 28, and to discharge to outside of the damper 25*a*. Moreover, following the procedure as described with reference to FIGS. 9A and 9B, it is possible to carry out the air-discharge step simultaneously with the recording step or the purge step.

Figure 11B:
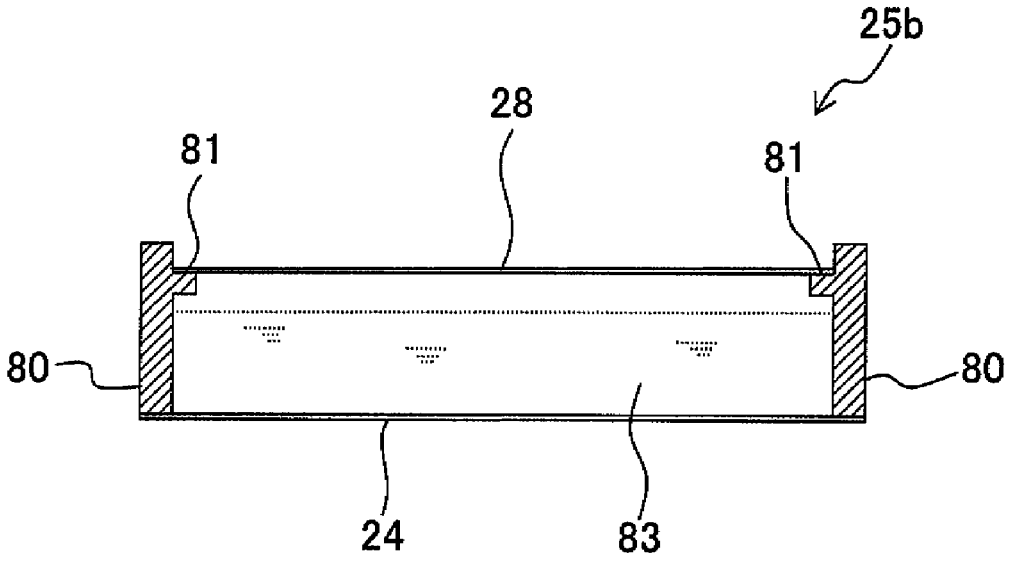

A damper 25*b* as shown in FIG. 11B has a structure in which the film 23 at the upper portion in the damper 25*a* is excluded. In the damper 25*b* having such structure, by letting the inside of the ink reservoir 83 to be under positive pressure, it is possible to discharge air trapped in an upper-portion space thereof to the outside the damper 25*b* through the gas-liquid separation membrane 28. Moreover, following the procedure as described with reference to FIGS. 10A and 10B, it is possible to carry out the air-discharge step simultaneously with the recording step or the purge step.

Moreover, in cases of the dampers 25*a* and 25*b*, since it is possible to make the ink reservoir 83 function as a pressure absorbing chamber (a damper) and at the same time as a gas-liquid separating chamber, it is possible to facilitate an improvement in the air-discharge capacity while suppressing an increase in the size of the dampers 25*a* and 25*b*. In a case of applying the damper 25*a* (25*b*) to a color ink jet printer, a plurality of dampers 25*a* (25*b*) is provided corresponding to colors of inks. In such case, it is possible to arrange the plurality of dampers 25*a* (25*b*) arbitrarily. For example, the plurality of dampers 25*a* (25*b*) may be arranged in a row horizontally, or the plurality of dampers 25*a* (25*b*) may be stacked.

In the damper of the present teaching, as the films 22 to 24, thin films of same material and same thickness may be used, or thin films of different materials and different thickness may be used. In other words, films of arbitrary materials and thickness may be used provided that the films have sufficient flexibility for functioning as a damper. At this time, for each of the films 22 to 24, a single-layer film may be used, or a plurality of films may be stacked. As the films 22 to 24, thin films of materials such as polypropylene, polyethylene, nylon, and polyethylene terephthalate may be used. Preferably, single layer thin films or multiple layer thin films of a film thickness in a range of approximately 10 μm to 100 μm, and more preferably, of a film thickness of approximately 50 μm may be used. Moreover, in the damper of the present teaching, also the gas-liquid separation membrane 28 may be single-layered or may be multiple-layered. In a case of using a multiple-layered gas-liquid separation membrane, for preventing blocking of the gas-liquid separation membrane, a plurality of gas-liquid separation membranes provided with fine holes of different diameters may be overlapped.

As it has been described above, the damper according to the present teaching may be used preferably in an ink jet head which jets an ink, and an ink-jet printer in particular. However, the subject of the present teaching is not restricted to such use, and may be applicable to a damper which is used in a liquid droplet jetting head which jets an arbitrary liquid, and a liquid droplet jetting apparatus. For instance, the present teaching is also applicable preferably to a damper which is used in an apparatus for manufacturing a color filter of a liquid crystal display unit by jetting a colored liquid and an apparatus for forming electric wiring by jetting an electroconductive liquid.

What is claimed is:

1. A damper provided in a channel through which a liquid is supplied to a liquid jetting head, the damper comprising:

a reservoir which stores the liquid and damps a pressure fluctuation in the liquid, the reservoir comprising:

a gas-liquid separation membrane that defines an upper portion of the reservoir and is configured to allow gas, but not liquid, to be removed from the upper portion of the reservoir, and a damper film which has a flexibility and which defines the reservoir at a lower side of the gas-liquid separation membrane.

2. The damper according to claim 1, wherein the damper film defines an area, of the reservoir, ranging from a lower portion up to a side portion of the reservoir.

3. The damper according to claim 1, wherein the reservoir is formed as a plurality of reservoirs which are arranged side-by-side in a row.

4. The damper according to claim 3, wherein the gas-liquid separation membrane is formed as a single sheet of the gas-liquid separation membrane, and the upper portions of the reservoirs are covered commonly by the single sheet of the gas-liquid separation membrane.

5. The damper according to claim 1, further comprising:

a negative-pressure chamber which applies a negative pressure to the gas-liquid separation membrane, and which is formed above the reservoir such that the gas-liquid separation membrane is arranged between the negative-pressure chamber and the reservoir.

6. The damper according to claim 1, wherein the gas-liquid separation membrane of the reservoir is exposed to an atmospheric space at an outer side of the damper.

7. A head unit which jets a liquid toward a medium, comprising:

a jetting head including a channel unit in which a plurality of nozzles through which the liquid is jetted and a plurality of pressure chambers which are communicated with the nozzles are formed, and a jetting-energy imparting mechanism which imparts a jetting energy to the liquid in the pressure chambers;

a damper as defined in claim 1, which liquid-communicates with the jetting head; and a carriage case which supports the jetting head and the damper.

8. The head unit according to claim 7, further comprising:

a sub tank which is liquid-communicated with the damper and the jetting head, and which temporary stores the liquid passed through the damper to supply the liquid to the jetting head.

9. A liquid jetting apparatus which jets a liquid onto a medium, comprising:

a head unit as defined in claim 8;

a transporting mechanism which transports the medium to a position facing the head unit;

a main tank which stores the liquid which is to be supplied to the head unit; and a liquid supply tube which is liquid-communicated with the main tank and the head unit.

10. The liquid jetting apparatus according to claim 9, wherein the liquid includes inks of a plurality of colors, and the main tank, the sub tank, and the reservoir are formed as a plurality of main tanks, a plurality of sub tanks, and a plurality of reservoirs, corresponding to the inks of the plurality of colors.

11. The liquid jetting apparatus according to claim 9, wherein the damper further includes a negative-pressure chamber which applies a negative pressure to the gas-liquid separation membrane and which is formed above the reservoir such that the gas-liquid separation membrane is arranged between the negative-pressure chamber and the reservoir, and the liquid jetting apparatus further includes a decompression pump which decompresses the negative-pressure chamber.

12. The liquid jetting apparatus according to claim 9, wherein the gas-liquid separation membrane of the reservoir is exposed to an atmospheric space at an outer side of the damper, and the liquid jetting apparatus further includes a booster pump which is communicated with the main tank, which pressurizes the liquid in the main tank to send the pressurized liquid to the reservoir of the damper, and which also pressurizes the liquid in the reservoir.

13. An air-discharge method of a damper comprising:

a recording step of performing a record by jetting a liquid passed through the damper as defined in claim 1, onto a recording medium via nozzles formed in the jetting head;

a purge step of performing a purge by discharging the liquid by jetting the liquid in the nozzles; and an air-discharge step of discharging air in the reservoir via the gas-liquid separation membrane by applying a negative pressure to an upper surface of the gas-liquid separation membrane of the damper, wherein the air-discharge step is performed while the recording step or the purge step is performed.

14. An air-discharge method of damper, comprising:

a pressurizing step of applying a positive pressure to the reservoir of the damper as defined in claim 1 to discharge an air in the reservoir via the gas-liquid separation membrane which covers the upper portion of the reservoir.

15. The air-discharge method of damper according to claim 14, further comprising:

a recording step of performing a record by jetting the liquid passed through the damper onto a recording medium via nozzles formed in the jetting head; and a purge step of performing a purge by discharging the liquid by jetting the liquid in the nozzles, wherein the air in the reservoir is discharged while the recording step or the purge step is performed, and the positive pressure applied in the pressurizing step is generated in the recording step or the purge step for jetting or discharging the liquid.

* * * * *